US007568459B2

(12) United States Patent
Best

(10) Patent No.: US 7,568,459 B2
(45) **Date of Patent: *Aug. 4, 2009**

(54) VALVETRAIN SWITCHABLE LEVER ARM FOR INTERNAL COMBUSTION ENGINE USING COLLAPSING PIVOT ELEMENT AT CENTER PIVOT

(75) Inventor: Richard Best, Garden City, MI (US)

(73) Assignee: Schaeffler KG, Herzogenaurach (DE)

( * ) Notice: Subject to any disclaimer, the term of this patent is extended or adjusted under 35 U.S.C. 154(b) by 131 days.

This patent is subject to a terminal disclaimer.

(21) Appl. No.: 11/780,670

(22) Filed: Jul. 20, 2007

(65) Prior Publication Data

US 2008/0017153 A1 Jan. 24, 2008

Related U.S. Application Data

(60) Provisional application No. 60/807,971, filed on Jul. 21, 2006.

(51) Int. Cl.
*F01L 1/18* (2006.01)

(52) U.S. Cl. ..... 123/90.39; 123/90.44; 74/559

(58) Field of Classification Search ..... 123/90.16, 123/90.2, 90.39, 90.44, 90.41, 90.43, 90.45, 123/90.46, 90.48, 90.52, 90.55, 90.4; 74/559, 74/567, 569; 29/888.2
See application file for complete search history.

(56) References Cited

FOREIGN PATENT DOCUMENTS

DE 32 39 941 5/1984

*Primary Examiner*—Ching Chang
(74) *Attorney, Agent, or Firm*—Lucas & Mercanti, LLP

(57) ABSTRACT

Proposed is a switchable valvetrain (1) for an internal combustion engine, having a row of rocker arms (2) which extend in the longitudinal direction of a cylinder head, which rocker arms (2) run via a recess (7) on their upper side (6) on a head (8) of a bearing journal (9), which bearing journal (9) is axially moveably arranged in a bore (10) of a carrier (11)/insert part (11*a*) which runs above, with piston-like coupling means (12) being provided for selectively coupling the bearing journal (9) to the carrier (11).

10 Claims, 1 Drawing Sheet

Fig.
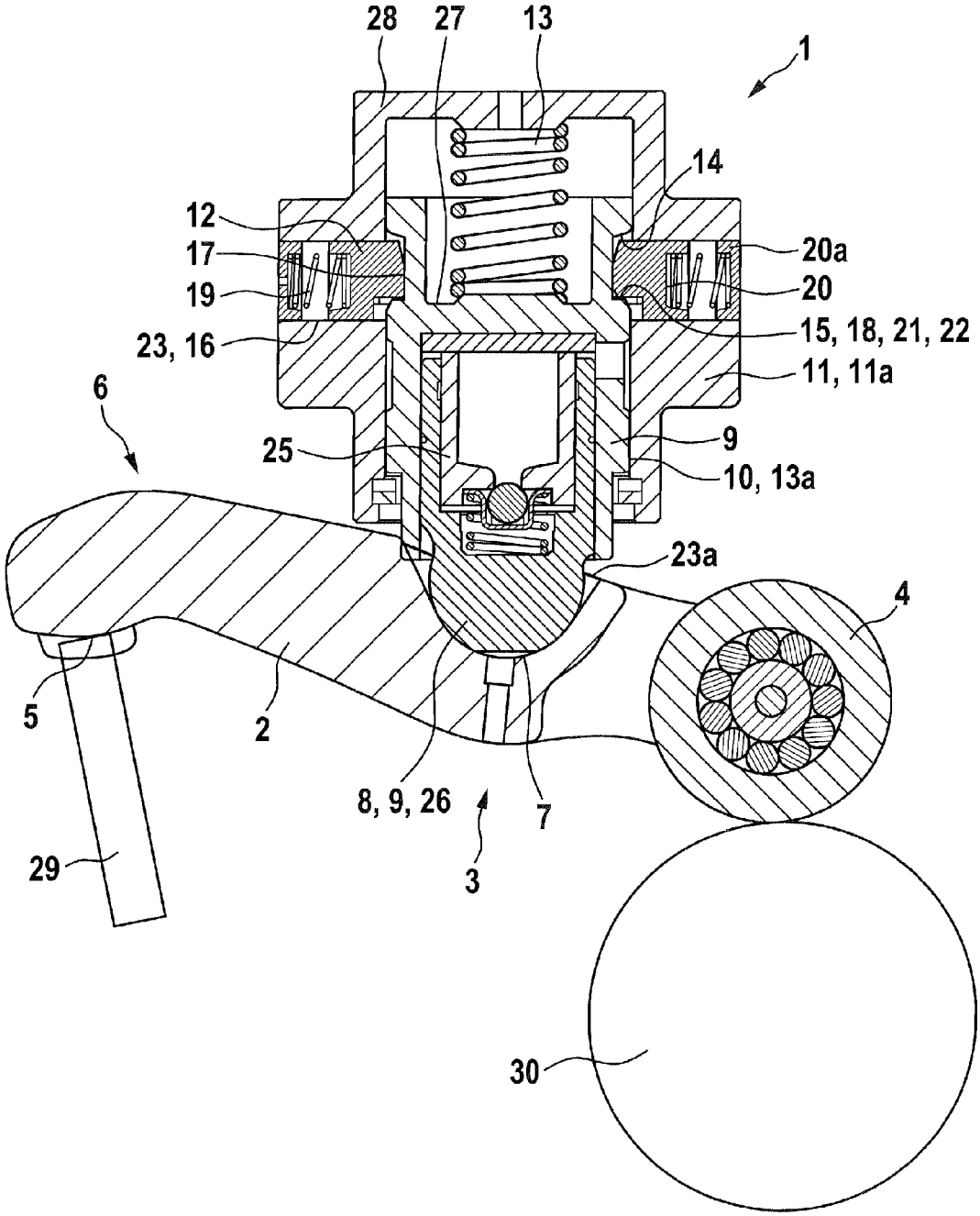

VALVETRAIN SWITCHABLE LEVER ARM FOR INTERNAL COMBUSTION ENGINE USING COLLAPSING PIVOT ELEMENT AT CENTER PIVOT

FIELD OF THE INVENTION

The invention relates to a switchable valvetrain for an internal combustion engine, having a row of rocker arms which extend in the longitudinal direction of a cylinder head, which rocker arms on the one hand intrinsically have, on an underside at one end, an at least indirect run-on face for at least one cam, and at the other end, a valve rest; and that run on the other hand via a recess on their upper side on a head of a bearing journal, with at least a subset of the bearing journals being axially moveably arranged in a corresponding bore of an above-situated carrier or of an insert part which is connected to the carrier, with each modular unit [moveable bearing journal/carrier or insert part] being assigned coupling means for selectively coupling the moveable bearing journal at least indirectly to the carrier, so that in the deployed state of the moveable bearing journal, a large valve lift is generated when coupled and a relatively small or zero valve lift is generated when decoupled, and with the respectively moveable bearing journal being acted on out of its bore by means of a lost motion spring.

BACKGROUND OF THE INVENTION

A valvetrain of said type is known from DE 32 39 941 A1 which is considered generic. A disadvantage of said valvetrain (see FIG. 1) is its extremely complexly designed coupling mechanism. Arranged laterally on the carrier is a bar-like slide which, in the coupled case, engages by means of a conical end face on one end into an annular groove of a bearing journal.

Said complex mechanism demands an unnecessarily large installation space in the cylinder head. It can be seen that the laterally engaging slide, with its surrounding construction, projects laterally beyond one end of the rocker arm. It is also clear that, as a result of the mere single-sided coupling, increased component loading in the coupled case can occur on the one hand, and the bearing journal has an increased tendency to tilt in the coupled case on the other hand. There are also only very few standard parts (previously used valvetrain parts) which can be resorted to.

OBJECT OF THE INVENTION

It is therefore the object of the invention to create a switchable valvetrain of the above-specified type, in which the stated disadvantages are eliminated.

ACHIEVEMENT OF THE OBJECT

According to the invention, said object is achieved in that an annular groove is arranged in the outer casing of the moveable bearing journal, the at least axially lower annular face of which annular groove runs orthogonally with respect to the axial line of the bore of the carrier or insert part, with said bore being intersected by at least one radially running or secant-shaped recess in the carrier or insert part, in which recess, in the decoupled case, is seated at least one piston as a coupling means, which coupling means, proceeding from its radially inner face end, is of stepped design with a flattening situated underneath, and which coupling means, for the coupled case, can be displaced with its flattening in sections onto the lower annular face of the annular groove of the bearing journal.

A valvetrain is therefore provided in which said disadvantages are eliminated. The solution has for example the advantage that the coupling means do not oscillate with the bearing journal, and are therefore not a constituent part of the moved masses during operation. In addition, it is very easy for hydraulic medium for the displacement of the coupling means (piston) to be supplied out of the carrier or out of the insert part. The annular groove in the outer casing of the bearing journal is also very simple to form in production terms, with the contact pressure being kept low in the coupled case on account of the flattenings proposed in the claim.

Two pistons situated diametrically opposite in the carrier/insert part, should preferably be provided as a coupling means, so that a tendency of the bearing journal to tilt in the coupled case is prevented. This arrangement also has the advantage that, should an insufficient "deployment" of one of the pistons occur after a triggered coupling command, at least the other piston provides support.

In the case of the use of an insert part, said insert part can be placed, pre-assembled with the piston etc., into a direct receptacle of the carrier.

The pistons should preferably run in transversely running through bores in the carrier/in the insert part, which carrier is for example produced from a lightweight material such as aluminum or the like.

It is clear that, for example in the case of multi-valve technology, not every bearing journal need be designed so as to be switchable in the carrier.

The pistons can be displaced particularly far radially in the coupling direction if their face end which faces toward the annular groove has a radii profile which correlates with that of the annular groove. A particularly good supporting surface is thereby formed.

In addition, it is provided in expansion of the invention that the piston and the annular groove are beveled in the contact region. Edge wear is thereby avoided.

In general, a displacement of the coupling means in one direction by means of hydraulic medium and in the other direction likewise by means of hydraulic medium or by means of pressure spring force is conceivable and provided. A variety of possible combinations of adjustment means which are known per se are available to a person skilled in the art at this point.

It is alternatively possible, instead of the annular groove, for a bore or the like to also be provided for engaging the piston. Here, however, the bearing journal must preferably be prevented from rotating.

It is particularly preferable if the carrier is embodied as a continuous rail for at least one row of the rocker arms which extend in the longitudinal direction of the cylinder head. Said carrier can therefore, as is also proposed, be stored, delivered to the engine manufacturer and installed there, in a fully pre-assembled state with rocker arms suspended on the bearing journal.

The scope of protection of the invention also relates to a valvetrain having a carrier which, in a unipartite fashion, is assigned a plurality of rows of rocker arms which run in the longitudinal direction of the cylinder head. But alternatively, the carrier can also be assigned only to individual rocker arms or groups of rocker arms.

Clamp-like elements such as sheet metal or wire clamps, as are known per se, are suitable as connecting means of the rocker arm to the heads of the bearing journals. If appropriate, a jointed connection or the like is also conceivable.

The recesses can be a constituent part of a through bore. It is therefore possible for two recesses (diametrically opposite one another) to be created in one working process. For both variants, it is also possible for recesses (at least three recesses) to be provided so as to be distributed about the periphery in a star shape.

In one physical embodiment, it is proposed to provide the valvetrain with hydraulic play compensation. For this purpose, it is proposed to provide the bearing journal with the play compensating device, so that said bearing journal is virtually of two-part design and composed of a pressure piston with the head which is held in a guide bore of a housing as a further constituent part of the bearing journal. Complex mechanical play setting measures can therefore be dispensed with, but are indeed also conceivable.

The lost motion spring which is required for the decoupled case is, according to a further expansion of the invention, embodied as at least one coil or spiral pressure spring, and should act at one end against a face end, which faces away from the rocker arm of the bearing journal, and at the other end against a base of the bore of the carrier. The base of the bore of the carrier can be connected in one piece to the carrier, with it however also being provided to apply a separate plug or the like in said region.

DESCRIPTION OF THE DRAWING

The invention is explained in more detail on the basis of the drawing. Illustrated is a switchable valvetrain 1 for an internal combustion engine. Said switchable valvetrain 1 is composed of an "overhead" carrier 11 for a row of rocker arms 2 which extend in the longitudinal direction of a cylinder head. The rocker arm 2 illustrated here has, on its underside 3 at one end a run-on face 4 (rolling-bearing-mounted roller) for a cam 30, and at the other end a valve rest 5 for at least one gas exchange valve 29.

Between the ends, on an upper side 6, the respective rocker arm 2 has a spherical-cap-shaped recess 7. A head 8 of a bearing journal 9 runs in said recess 7. The head 8 is a constituent part of a pressure piston 26 of a hydraulic play compensating device 25. The bearing journal 9, which therefore has the play compensating device 25, runs with its outer casing 13*a* in a downwardly open bore 10 of the carrier 11/insert part 11*a*. Said bearing journal 9 is held in a telescopically moveable manner relative to said bore 10. As can also be seen, the outer casing 13*a* of the bearing journal 9 has an annular groove 14. At least the lower annular face 15 of said annular groove 14 runs perpendicularly with respect to the axial line of the bearing journal 9.

Orthogonally with respect to the longitudinal direction of the carrier 11 (a cross section is shown), per bearing journal 9, two diametrically oppositely situated recesses 16 are formed. Said recesses 16 run in a through bore 23. Seated in each of said recesses 16 is a piston as a coupling means 12. Said pistons 12 are shown in their state in which they are engaged into the annular groove 14 (coupled state). Here, said pistons 12 have, proceeding from their radially inner face end 17, in each case one flattening 18 on their underside, which flattening 18, in the coupled case, bears against the lower annular face 15 of the annular groove 14. The coupling state shown is produced by spring means 19 (pressure springs). The latter act against an outer face end 20 of the piston, and are supported radially outward on plug 20*a*. A return displacement of the piston 12 can be provided by means of hydraulic medium which can be conducted in front of its inner face end 17, with other variants also being conceivable.

In addition, it is disclosed in the drawing that a lost motion spring 13 is integrated within the bore 10 of the carrier 11/insert part 11*a*. Said lost motion spring 13 is seated at one end against a face end 27, which faces away from the rocker arm 2 of the bearing journal 9, and acts at the other end against a base 28 of the bore 10. As can be seen, the respective bore 10 is designed so as to be closed off in the manner of a pot, so that the base 28 is an integral constituent part of the carrier 11. However, it is also possible and provided to arrange a separate cap, or the like, as a "base".

In order to avoid edge wear, it is proposed to bevel an edge region 21 of the lower annular face 15 of the annular groove 14, and likewise an edge region 22 of the flattening 18 of the respective radially inner face end 17 of the piston 12.

It is also provided to fix the respective rocker arm 2 to the head 8 of the bearing journal 9 by means of a connecting means 23*a* (holding clamp or the like) which is formed in the region of the recess 7 of said rocker arm 2. The entire modular unit can be stored, delivered to the engine manufacturer and installed there, in a pre-assembled state. The assembly expenditure at the engine manufacturer is therefore drastically reduced.

LIST OF REFERENCE SYMBOLS

1) Valvetrain
2) Rocker arm
3) Underside
4) Run-on face
5) Valve rest
6) Upper side
7) Recess
8) Head
9) Bearing journal
10) Bore
11) Carrier
11*a*) Insert part
12) Coupling means, piston
13) Lost motion spring
13*a*) Outer casing
14) Annular groove
15) Lower annular face
16) Recess
17) Inner face end
18) Flattening
19) Spring means
20) Outer face end
20*a*) Plug
21) Edge region, annular groove
22) Edge region, flattening
23) Through bore
23*a*) Connecting means
24) not allocated
25) Play compensating device
26) Pressure piston
27) Face end
28) Base
29) Gas exchange valve
30) Cam

The invention claimed is:

1. A switchable valvetrain for an internal combustion engine, comprising:

a row of rocker arms which extend in a longitudinal direction of a cylinder head, each of the rocker arms having, on an underside at one end, an indirect run-on face for a cam, and at the other end, a valve rest;

a rocker arm recess on an upper side of the rocker arm and a head of a bearing journal in the rocker arm recess, with at least a subset of each of the bearing journals being axially moveably arranged in a corresponding bore of an above-situated carrier, a coupling means in the carrier for selectively coupling the bearing journal, at least indirectly to the carrier, so that in a deployed state of the bearing journal, a large valve lift is generated when coupled and a relatively small or zero valve lift is generated when decoupled, and with the bearing journal urged out of the bore by means of a lost motion spring, an annular groove arranged in an outer casing of the bearing journal, an axially lower annular face of the annular groove runs orthogonally with respect to the axial line of the bore, the bore intersected by at least one radially running coupling recess in the carrier, in the decoupled case, at least one piston of the coupling means seated in the coupling recess, the piston having a radially inner face end with a flattening situated underneath the inner face end, and, in the coupled case, the flattening situated on the lower annular face of the annular groove of the bearing journal.

2. The switchable valvetrain according to claim 1, wherein a displacement of the piston in the coupled case is effected radially inward either by a mechanical spring means which is supported at one end on an outer face end of the piston and at the other end on a plug at the outer end in the coupling recess, or by means of a hydraulic medium supplied in front of the outer face end of the piston from the carrier and a return displacement of the piston in the decoupled case is effected radially outward by means of hydraulic medium supplied in front of the inner face end of the piston.

3. The switchable valvetrain according to claim 1, wherein the inner face end, which faces towards the annular groove of the piston, has a curvature which correlates at least approximately with a radius of the annular groove.

4. The switchable valvetrain according to claim 1, wherein edge regions, which are in engagement with one another, of the annular groove and of the flattening of the piston, are beveled in a transition region to the inner face end.

5. The switchable valvetrain according to claim 1, wherein the carrier is embodied as a continuous rail for at least one row or at least a partial section of one row of the rocker arms which extend in the longitudinal direction of the cylinder head.

6. The switchable valvetrain according to claim 1, wherein the carrier is produced from a lightweight material.

7. A method for assembling the switchable valvetrain according to claim 1, wherein the valvetrain is provided fully pre-assembled with rocker arms retained thereon in a suspended manner by connecting means, and is subsequently mounted as a modular unit on the cylinder head of the internal combustion engine.

8. The switchable valvetrain according to claim 1, wherein the bearing journal is provided with a hydraulic play compensating device having a pressure piston which is a constituent part of the bearing journal and the head.

9. The switchable valvetrain according to claim 1, wherein the rocker arm is retained on the head of the bearing journal by a connecting means.

10. The switchable valvetrain according to claim 1, wherein the lost motion spring in the bore, is a coil or spiral pressure spring, and acts at one end against a face end, which faces away from the rocker arm of the bearing journal, and at the other end against a base, which is closed off either in one piece or by means of a separate plug; of the bore of the carrier.

* * * * *